US005979026A

United States Patent [19]

Anthony

[11] Patent Number: 5,979,026

[45] Date of Patent: Nov. 9, 1999

[54] BUCKLE DUAL RELEASE

[75] Inventor: James R. Anthony, Carmel, Ind.

[73] Assignee: Indiana Mills and Manufacturing, Inc., Westfield, Ind.

[21] Appl. No.: 08/695,122

[22] Filed: Aug. 5, 1996

[51] Int. Cl.[6] ..... A44B 11/26

[52] U.S. Cl. ..... 24/633

[58] Field of Search ..... 24/633, 573.1, 24/640–642

[56] References Cited

U.S. PATENT DOCUMENTS

| | | | |
|---|---|---|---|
| 4,624,033 | 11/1986 | Orton | 24/633 |
| 4,692,970 | 9/1987 | Anthony et al. . | |
| 5,023,981 | 6/1991 | Anthony et al. . | |
| 5,038,446 | 8/1991 | Anthony et al. . | |
| 5,142,748 | 9/1992 | Anthony et al. . | |
| 5,182,837 | 2/1993 | Anthony et al. . | |
| 5,283,933 | 2/1994 | Wiseman et al. . | |

FOREIGN PATENT DOCUMENTS

| | | | |
|---|---|---|---|
| WO 84/01275 | 4/1984 | WIPO | 24/633 |

*Primary Examiner*—James R. Brittain

*Attorney, Agent, or Firm*—Woodard, Emhardt, Naughton Moriarty & Mcnett

[57] ABSTRACT

A buckle tongue combination having a dual release for unlocking the tongue from the buckle. In the preferred embodiment, a spring bias slide cover mounted to the housing extends over a push button depressible to force a locking pawl apart from the tongue unlocking the tongue from the buckle. In an alternate embodiment, a button lock extends partially over and beneath the push button and between the pawl and housing bottom wall. A spring normally urges the button lock against the push button limiting movement of the button but is yieldable to allow the button lock to be moved apart from the button.

6 Claims, 4 Drawing Sheets

BUCKLE DUAL RELEASE

BACKGROUND OF THE INVENTION

Field of the Invention

This invention is in the field of buckles, and particularly those buckles used in vehicle restraint systems for securing straps together.

Description of the Prior Art

A variety of buckles have been designed having movable pawls to releasably lock to a mating tongue thereby joining straps together attached to a buckle and tongue. For example, the commonly owned U.S. Pat. No. 5,283,933 discloses a buckle having a lower housing containing an upwardly biased pawl to lockingly engage a tongue inserted into the mouth of the buckle. A push button is slidable within an upper housing attached to the lower housing and is movable to force the pawl apart from the tongue releasing the buckle and tongue. Different embodiments of such a buckle and tongue are disclosed in the aforementioned patent and also in the commonly owned U.S. Pat. Nos. 5,182,837, 5,142,748, 5,038,446, 5,023,981, and 4,692,970.

It is desirable to provide a buckle which requires two actions to disengage the tongue or tongues from the buckle. Disclosed herein is a buckle having a cover or a lock which extends over the push button thereby necessitating movement of the cover relative to the button prior to the button being depressed to disengage the tongue from the buckle. In one embodiment, the cover extends entirely over the button whereas in the second embodiment the cover extends partially over and beneath the button.

SUMMARY OF THE INVENTION

One embodiment of the present invention includes a belt buckle to lockingly engage a buckle tongue comprising a belt buckle with a tongue mouth and a locking pawl movable to a first position Lo lockingly engage the tongue inserted into the mouth and to a second position to disengage the tongue. The buckle includes a push button movably mounted thereto engageable with the locking pawl and a button cover normally extending over the button limiting access thereto but movable relative to the button allowing the button to be depressed.

It is an object of the present invention to provide a buckle which requires two actions to disengage the tongue or tongues from the buckle.

A further object of the present invention is to provide a dual release buckle requiring two actions for release button which can be done easily by movement with the same finger or thumb.

In addition, it is an object of the present invention to provide a new and improved buckle for use in vehicle restraint systems.

Related objects and advantages of the present invention will be apparent from the following description.

DESCRIPTION OF THE PREFERRED EMBODIMENTS

Figure 2:
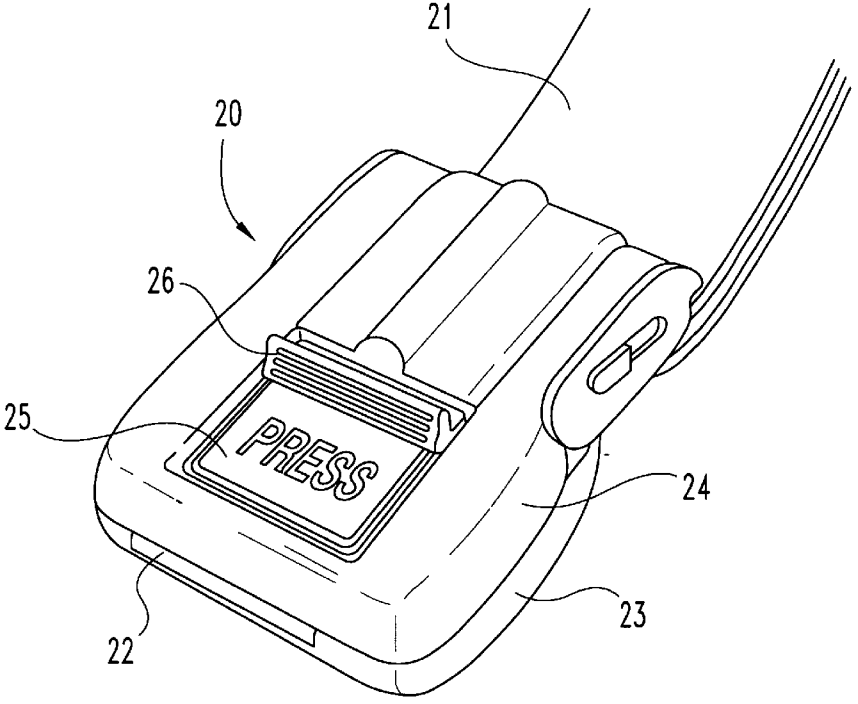
FIG. 2 is the same view as FIG. 1 only showing the cover moved from over the button allowing access thereto.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
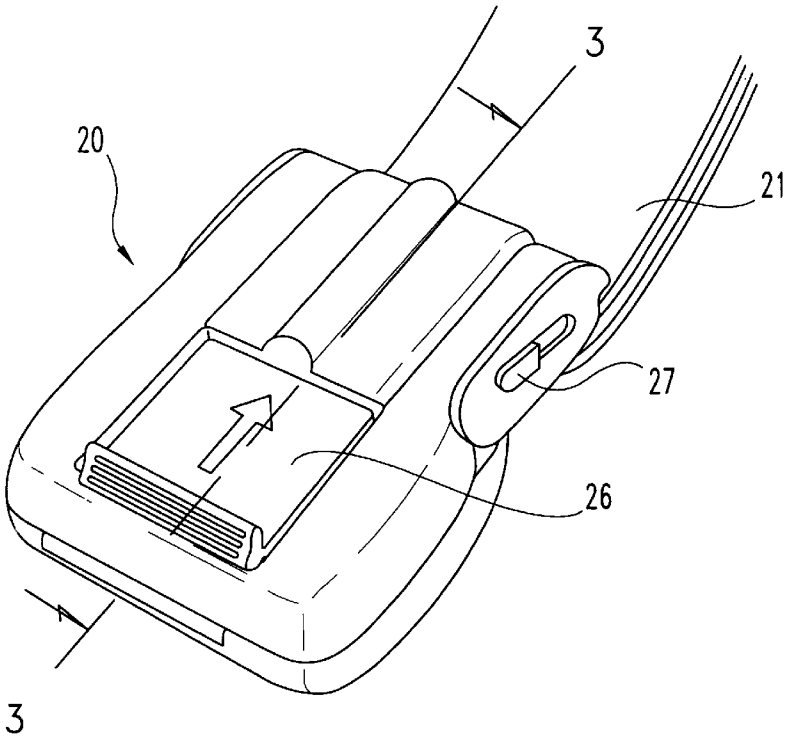
FIG. 1 is a perspective view of the preferred embodiment of the buckle including a button cover incorporating the present invention.

Referring now more particularly to FIGS. 1 and 2, there is shown a push-button buckle 20 adjustably attached to a web or belt 21. The mouth 22 of the buckle is sized to receive a tongue, in turn, attached to a second strap. The buckle includes a lower housing 23 and upper housing 24 fixedly secured together and enclosing a spring biased pawl normally urged upwardly to lockingly engage the tongue inserted in mouth 22. A push button 25 is operable when depressed to force the pawl downwardly apart from the inserted tongue thereby unlocking the tongue from the pawl and also from the buckle. A cover 26 is normally urged outwardly by a spring to conceal button 25 as depicted in FIG. 1. Cover 26 may be moved to reveal button 25 as illustrated in FIG. 2 thereby enabling button 25 to be depressed unlocking the tongue from the buckle.

The construction of buckle 20 except for cover 26 is well known and is illustrated for example in the commonly owned U.S. Pat. No. 5,283,933 herewith incorporated by reference. Likewise, a similar type of buckle is disclosed in FIG. 6 herein. More specifically, buckle 20 includes a lower housing 23 (FIG. 1) having an upwardly spring biased pawl having an upwardly extending projection to engage a mating aperture provided in the tongue insertable into mouth 22. A metal reinforcement plate may be provided between housings 23 and 24 with button 25 then being contained and held by housing 24. Button 25 is normally biased by a separate spring in an upward direction away from the pawl with the button being depressible having a pair of downwardly extending legs contacting the pawl and forcing the pawl downwardly and apart from the tongue when the button is depressed. A cross-bar 27 is provided in the rear portion of the buckle around which strap 21 extends securing the strap to the buckle.

Figure 6:
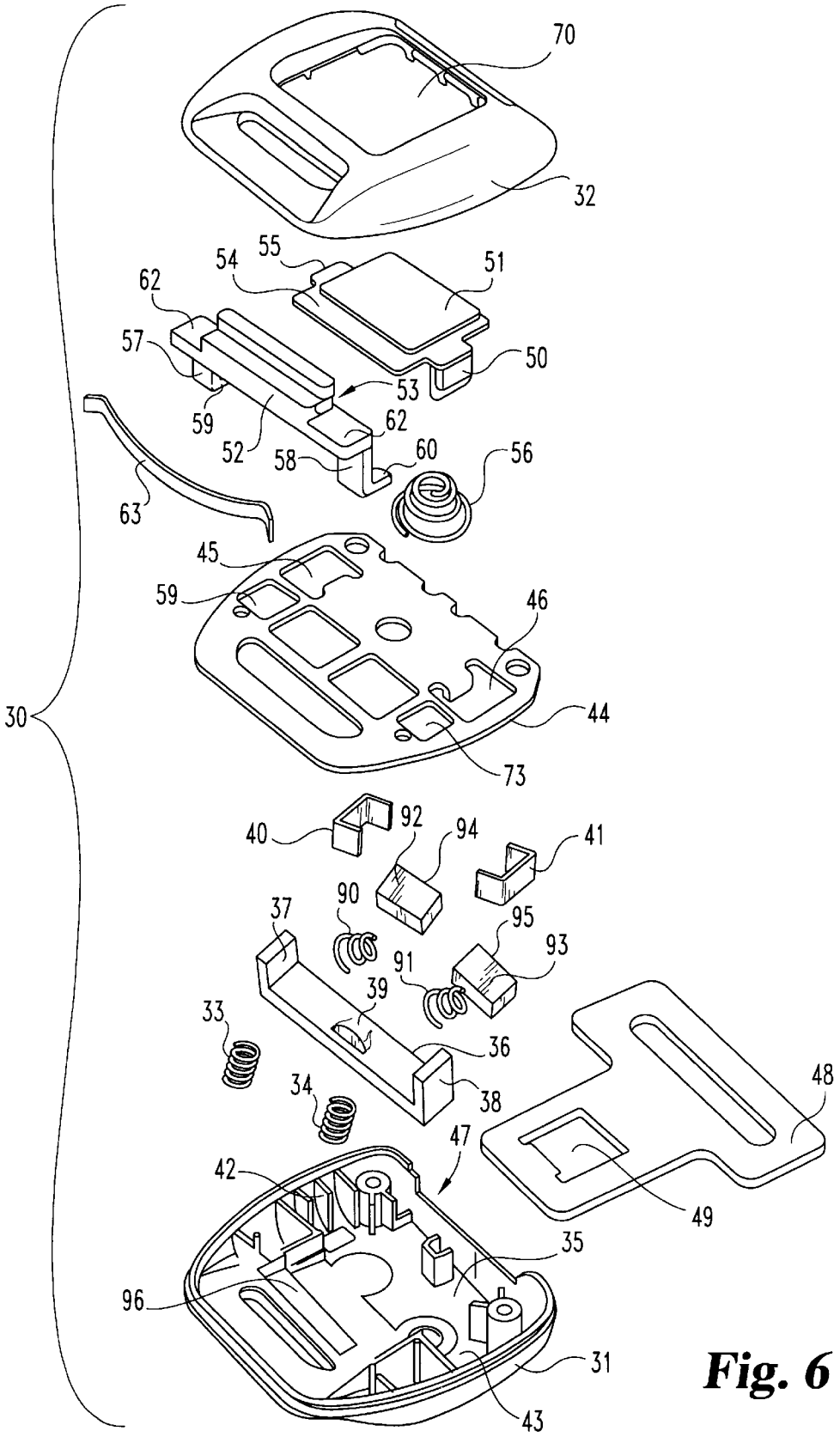
FIG. 6 is a exploded perspective view of an alternate embodiment of the buckle including a push button cover lock.

An alternate embodiment of the buckle is depicted in FIG. 6. Buckle 30 includes a lower housing 31 and an upper housing 32 fixedly secured together. A pair of helical springs 33 and 34 rest atop the bottom wall 35 of lower housing 31 and extend upwardly contacting the downwardly facing surface of pawl 36. The pawl includes a pair of upwardly extending arms 37 and 38 which are slidable respectively in upwardly extending C-shaped and mutually facing channels 40 and 41 respectively positioned within side cavities 42 and 43 of lower housing 31. A metal plate 44 is positioned between lower housing 31 and upper housing 32 increasing the rigidity of the buckle. Channels 40 and 41 project through and are held in holes 45 and 46 provided in end plate 44. A mouth 47 is formed between the cut out upper edge of lower housing 31 and the bottom surface of plate 44.

Tongue 48 includes an aperture 49 through which the upwardly extending projection 39 of pawl 36 is positionable locking the tongue to the buckle when the tongue is inserted into mouth 47.

Push button 51 has a pair of downwardly extending legs 55 and 50 extendable through holes 45 and 46 into channels 40 and 41 contacting respectively the upwardly extending arms 37 and 38 of pawl 36. A helical spring 56 positioned atop plate 44 and between the push button and the plate is operable to normally urge the push button to its upward position with the push button extending through hole 70 of the top housing 32. In similar fashion, buckle 20 includes a lower housing 31 with pawl 36, springs 33 and 34, channels 40 and 41, reinforcement plate 44, spring 56, push button 51, and cover 32 with FIG. 6 as heretofore described applying equally to buckle 20.

Tongue ejectors 92 and 93 are slidably mounted to housing 31 within cavity 96 and are urged forwardly by springs 90 and 91 toward tongue mouth 47. Ejectors 92 and 93 normally are positioned atop pawl 36 holding the pawl down enabling insertion of tongue 48. When the tongue is inserted, the forward edge of the tongue contacts edge 94 and 95 of ejectors 92 and 93 pushing the ejectors rearwardly off pawl 36 and allowing the pawl to move upwardly locking projection 39 in hole 49 of the tongue. Such ejectors are shown in the aforementioned U.S. Pat. No. 5,283,933 previously incorporated by reference.

Buckles 20 and 30 are distinguishable in that buckle 20 includes a slide cover 26 normally concealing button 25 but movable to allow access thereto while buckle 30 includes a cover lock 52 which extends only partially over button 51 but also at the same time extending beneath the button and having lower legs extending beneath pawl 36.

Figure 7:
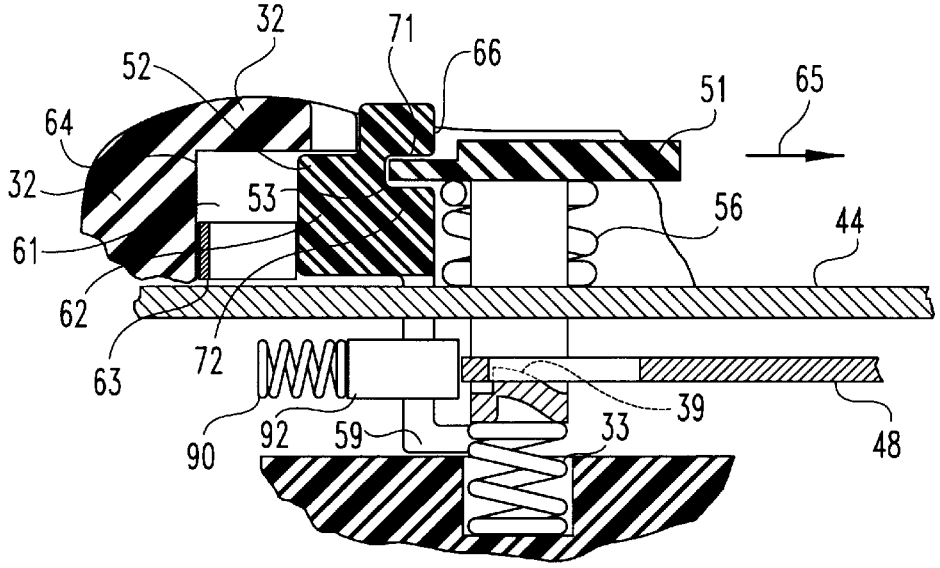
FIG. 7 is a fragmentary cross-sectional view of the buckle of FIG. 6 locked to a tongue.
Figure 8:
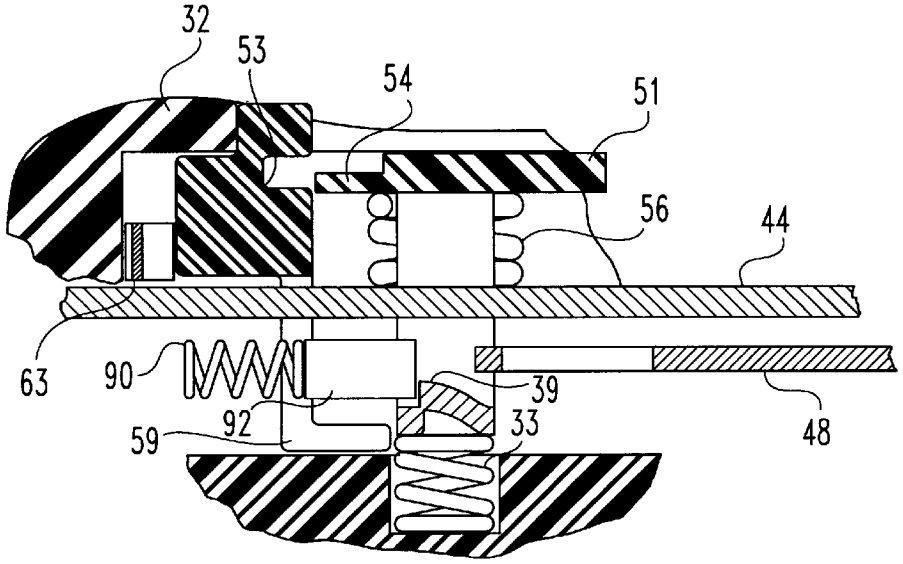
FIG. 8 is the same view as FIG. 7 only showing the buckle unlocked relative to the tongue.

Cover lock 52 includes a slot 53 (FIGS. 6 and 7) opening toward mouth 47 to slidably receive the rearwardly extending lip 54 of push button 51. The cover lock, therefore, includes a wall 71 (FIG. 7) or flange which extends only partially over and atop push button 51 and a second wall 72 or flange which extends only partially beneath lip 54 of push button 51. Walls 71 and 72 are formed by slot 53. A pair of downwardly extending legs 57 and 58 (FIG. 6) are integrally attached to cover lock 52 and extend through respectively holes 59 and 73 of plate 44 with the legs extending downwardly eventually contacting bottom wall 35 of the lower buckle housing. Legs 57 and 58 include respectively forwardly extending fingers 59 and 60 extendable beneath pawl 36. Upper housing 32 includes a guide cavity 61 (FIG. 7) slidably receiving the rearwardly projecting portion 62 of cover lock 52.

A leaf spring 63 (FIG. 6) is positioned within cavity 61 atop wall 44. The leaf spring is further positioned between the rearwardly facing portion 62 of cover lock 52 and the forwardly facing surface 64 (FIG. 7) of top housing 32. The leaf spring is operable to normally force cover lock 52 in the direction of arrow 65 (FIG. 7) thereby positioning push button lip 54 within slot 53 preventing the push button from being depressed and maintaining the positioning of fingers 59 and 60 between pawl 36 and wall 35. Wall 71 of cover lock 52 extends over lip 54 and then upwardly above the push-button forming a projection with a forwardly facing surface 66.

To unlock the tongue from the buckle, the user with a thumb or a single finger contacts surface 66 and pushes cover lock 52 in a direction opposite of arrow 65 thereby compressing leaf spring 63 and moving the cover lock further into cavity 61 until lip 54 is positioned completely out of slot 53 and fingers 59 and 60 are rearward of pawl 36 thereby allowing the same thumb or finger to then depress button 51. Downward movement of the push button results in legs 55 and 50 forcing arms 37 and 38 of pawl 36 downwardly compressing springs 33 and 34 and moving projection 39 out of hole 49 of tongue 48 releasing the tongue from the pawl and buckle. Simultaneously, ejectors 92 and 93 move forwardly over the pawl ejecting the tongue(s) from the buckle. Removal of the thumb and finger from atop the push button causes the springs 33 and 34 to move the pawl upwardly to beneath the ejectors, while at the same time spring 56 causes the push button to move upwardly until lip 54 is aligned with slot 53. Cover lock 52 is prevented from moving in the direction of arrow 65 since the forward end of fingers 59 and 60 contact the rear edge of pawl 36. The pawl is therefore set for the next insertion of tongue 48. Insertion of the tongue forces the ejectors rearwardly off the pawl allowing the pawl to snap up locking projection 39 in tongue hole 49 while fingers 59 and 60 slide between the pawl and bottom wall 35 and button lip 54 is positioned in slot 53 locking the button in place.

The forward extending fingers 59 and 60 of cover lock 52 are positioned between pawl 36 and bottom wall 35 whenever the cover lock is in its most forward position and lip 54 is positioned within slot 53. Thus, pawl 36 cannot be moved toward bottom wall 35 until cover lock 52 is moved rearwardly positioning not only lip 54 out of slot 53 but also fingers 59 and 60 from between the pawl and bottom wall.

The top housing 24 of the preferred embodiment of buckle 20 (FIG. 3) includes a rear extension 75 located behind the cavity containing the pawl, springs and push button for containing a cross bar 27 lockingly receiving web 21. Rear extension 75 also includes a pair of spaced apart walls 76 and 77 integrally connected together and containing a helical spring 78 normally urging cover 26 to its forward position concealing push button 25. Slide 26 has a thickness sized to slide between walls 76 and 77 thereby compressing spring 78 when pressure is applied to upwardly extending surface 79 of the slide forcing the slide rearwardly allowing access to push button 25. Cover 26 extends horizontally over button 25 and then is turned upwardly forming an outwardly turned flange having surface 79 thereon. Push button 25 includes the downwardly extending pair of legs such as legs 55 and 50 for push button 51 (FIG. 6) and is identical thereto except push button 25 does not include the rearwardly extending lip 54.

Figure 3:
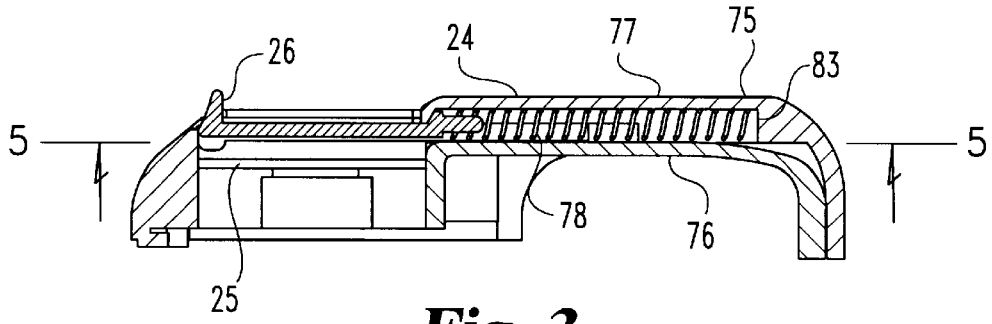
FIG. 3 is an enlarged cross-sectional view of the top housing of the buckle taken along the line 3—3 of FIG. 1 and viewed in the direction of the arrows.
Figure 4:
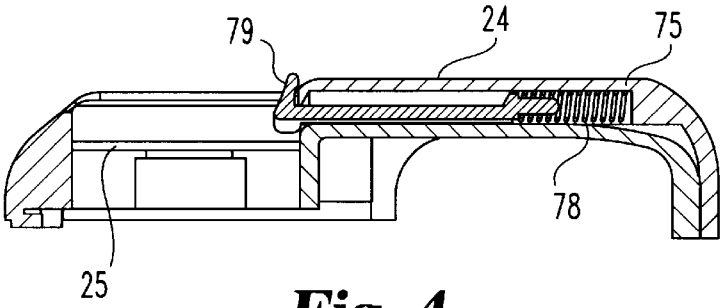
FIG. 4 is the same view as FIG. 3 only showing the cover moved relative to the push button allowing access thereto.
Figure 5:
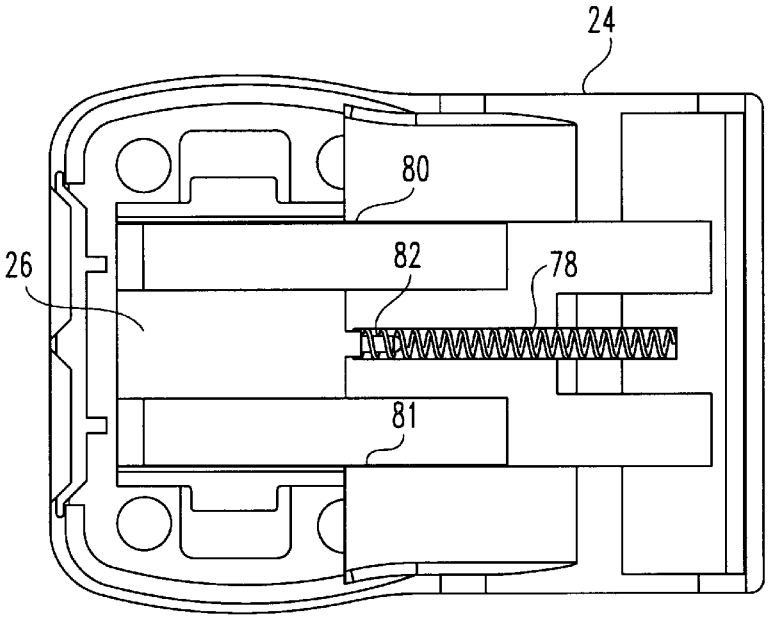
FIG. 5 is a cross sectional view of the top housing and cover taken along the line 5—5 of FIG. 3 and viewed in the direction of the arrows.

Cover 26 includes a pair of longitudinally extending side edges 80 and 81 which are slidable within mutually facing grooves formed in top housing 24 to guide the cover from the extended position of FIG. 3 to the retracted position of FIG. 4. The mutually facing grooves formed in the top housing slidably receiving side edges 80 and 81 of cover 26 form a guide means extending in the direction away from tongue mouth 22 guiding the cover to and from the push button. A rearwardly extending arm 82 on cover 26 receives one end of spring 78 having its opposite end contacting forwardly facing surface 83 extending between walls 75 and 76.

Many variations are contemplated and included in the present invention. For example, cover 26 and button lock 52 are shown as movable in a direction away from respectively tongue mouths 22 and 47 in order to allow access to the push button for the depressing of the button and unlocking of the buckle from the tongue. Alternatively, the housing may be constructed to require movement of cover 26 and button lock 52 toward respectively mouth 22 and 47 in order to allow access to the push button and the depressing thereof.

In such a design, the buckle housing is increased in length between the mouth and push button to allow mounting of the cover and button lock.

The drawings herein disclose a single tongue; however, it is to be understood the present invention may be utilized with a buckle and tongue combination having multiple tongues such as disclosed in the commonly owned prior listed U.S. patents.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A belt buckle lockable with a tongue comprising:

a frame;

a locking pawl movably mounted on said frame and having a tongue engaging portion movable between a tongue locking position and a tongue unlocking position;

a housing enclosing said frame and said locking pawl and having a tongue mouth leading to said tongue engaging portion and further having a button opening;

a spring engaged with said locking pawl operable for said tongue engaging portion to lockingly engage a tongue inserted into said mouth;

a depressible button movably mounted within said housing being movable from an outer position to a depressed position against said locking pawl to move said locking pawl relative to said tongue; and, a button lock slidably mounted in said housing and movable from a first position adjacent said depressible button limiting said button from being depressed against said locking pawl and further movable to a second position apart from said button allowing said button to be moved to said depressed position; and wherein:

said button lock has a first portion extending beneath said button limiting movement of said button toward said pawl until said button lock is moved apart from said button, said button lock is slidably movable in a direction to and from said tongue mouth when moved between said first position and said second position allowing a thumb to simultaneously move said button lock in said direction moving said first portion from beneath said button while depressing said button unlocking said buckle from said tongue.

2. The belt buckle of claim 1 wherein:

said button lock has a second portion extending outwardly of said button, said button lock movable apart from said button by forcing said second portion apart from said button.

3. A belt buckle lockable with a tongue comprising:

a frame;

a locking pawl movably mounted on said frame and having a tongue engaging portion movable between a tongue locking position and a tongue unlocking position;

a housing enclosing said frame and said locking pawl and having a tongue mouth leading to said tongue engaging portion and further having a button opening;

a spring engaged with said locking pawl operable for said tongue engaging portion to lockingly engage a tongue inserted into said mouth;

a depressible button movably mounted within said housing being movable from an outer position to a depressed position against said locking pawl to move said locking pawl relative to said tongue;

a button lock slidably mounted in said housing and movable from a first position adjacent said depressible button limiting said button from being depressed against said locking pawl and further movable to a second position apart from said button allowing said button to be moved to said depressed position; and, a spring mounted in said housing and engaged with said button lock normally operable to urge said button lock to said first position but yieldable to allow said button lock to move from said first position to said second position, and wherein, said button lock has a first flange extending beneath said button limiting movement of said button toward said pawl until said button lock is moved apart from said button, said button lock has a second flange extending outwardly of said button, said button lock moveable apart from said button by forcing said second flange apart from said button, said button lock is movable in a direction away from said tongue mouth when moved from said first position to said second position allowing a thumb to simultaneously move said button lock in said direction moving said second flange from beneath said button while depressing said button unlocking said buckle from said tongue.

4. A belt buckle comprising:

a belt buckle including a housing with an opening and a button movable mounted in said housing with said button located at said opening, said buckle further including a pawl movably mounted therein, said housing including a tongue mouth to receive a tongue inserted therein to lockingly engage said pawl, said buckle further including a button lock slidably mounted thereto with said button lock movable into engagement with said button limiting movement of said button with said button lock movable out of engagement with said button allowing said button to be depressed against said pawl to release said pawl from a tongue inserted into said mouth; and wherein:

said button lock includes a first blocking portion movable lockingly into said button to block movement of said button toward said pawl, said button lock and said first blocking portion movable in a direction to and from said tongue mouth allows a thumb to simultaneously move said button lock in said direction moving said first blocking portion away from said button while depressing said button unlocking said buckle from said tongue.

5. The buckle of claim 4 wherein:

said button lock includes a thumb portion extending outwardly of said button allowing engagement of said thumb portion to move said button lock apart from said button and said blocking portion from beneath said button allowing said button to be depressed against said pawl unlocking said tongue from said buckle.

6. The buckle of claim 4 wherein:

said housing includes a bottom wall upon which said pawl is positioned, said button lock includes a second blocking portion movable between said pawl and said bottom wall of said housing.

* * * * *